United States Patent [19]

Mansour

[11] 4,067,598

[45] Jan. 10, 1978

[54] MECHANICAL SECURITY DEVICE FOR DOORS

[76] Inventor: Gerald J. Mansour, 1009 Detroit St., Flint, Mich. 48502

[21] Appl. No.: 748,589

[22] Filed: Dec. 8, 1976

Related U.S. Application Data

[63] Continuation-in-part of Ser. No. 701,786, July 1, 1976, abandoned.

[51] Int. Cl.[2] ..... E05C 17/30

[52] U.S. Cl. ..... 292/259 R

[58] Field of Search ..... 292/259, 205, 338, 339, 292/DIG. 46, 262

[56] References Cited

U.S. PATENT DOCUMENTS

| | | | |
|---|---|---|---|
| Re. 27,161 | 8/1971 | Raymon | 292/338 |
| 109,330 | 11/1870 | Maddox | 292/259 X |
| 677,432 | 7/1901 | Biehl | 292/205 X |
| 924,277 | 6/1909 | Saphier | 292/259 |
| 1,394,278 | 10/1921 | Cirac | 292/205 |
| 2,421,275 | 5/1947 | Lopez | 292/259 |

*Primary Examiner*—Richard E. Moore

*Attorney, Agent, or Firm*—Cullen, Settle, Sloman & Cantor

[57] ABSTRACT

A mechanical security device or door guard in the form of an elongated latching member arranged to extend laterally across and in close proximity to a door when closed for positively maintaining the door in a closed position, with one end of the latching member being pivotally connected to one vertical door jamb located adjacent the edge of the door provided with the handle and the other end of the latching member being removably received by a generally J-shaped clip carried by the other vertical door jamb to which the door is hingedly connected.

5 Claims, 4 Drawing Figures

MECHANICAL SECURITY DEVICE FOR DOORS

CROSS-REFERENCES TO RELATED APPLICATIONS

This application is a continuation-in-part of my copending application Ser. No. 701,786, filed July 1, 1976.

BACKGROUND OF THE INVENTION

1. Field of the Invention

This invention relates to mechanical security devices for doors for preventing ingress into and egress from buildings such as houses, apartments, hotel-motel rooms, mobile homes, offices, businesses, tool rooms, stock rooms, or anywhere else where privacy, protection and security of persons, properties and possesions are required.

2. Description of the Prior Art

It is well known in the art to use a bar against a door and to provide hardware or supports and opposite door jambs to carry the ends of the bar. In addition, chains and other types of fastening devices are used to secure a door in a closed position to the door jamb.

SUMMARY OF THE PRESENT INVENTION

It is feature of the present invention to provide a mechanical security device or door guard that consists of an elongated steel bar or latching member and suitable clips that mount easily to the opposing door jambs, with one end of the latching member pivotally connected to one door jamb, with the latching member when not in use hanging unobtrusively besides one edge of the door instantly ready for use; and when it is required to secure the door, the latching member is simply raised by its free end and dropped into the cradle clip on the door jamb to which the door is hingely connected.

A further feature of the present invention is to provide a mechanical security device or door guard that seals the door to outsiders until it is released from the inside, such release being accomplished by simply lifting the door guard from the cradle clip.

A still further feature of the present invention is to provide a mechanical security device or door guard which is economical to manufacture, easy to install in a matter of minutes, simple to operate, requires no operating or maintainence costs and provides leverage or a mechanical advantage when in use.

Another feature of the present invention is to permit a person to remove the latching member from the cradle clip and partially open the door to see who is at the door, while maintaining control of the door, ready to push the door closed and to immediately reinsert the latching member in the cradle clip if required.

DESCRIPTION OF THE PREFERRED EMBODIMENT

Figure 1:
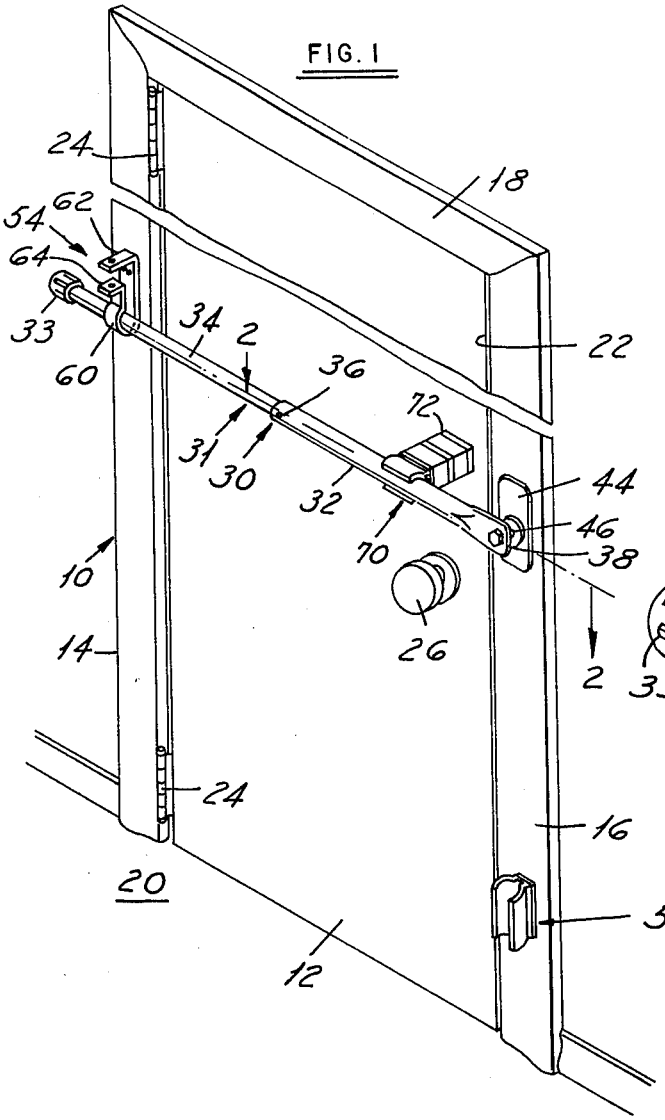
FIG. 1 is a perspective view showing a door sealed in a door opening by means of the mechanical security device.

FIG. 1 illustrates a conventional door frame 10 having a door 12 swingably mounted therein. The frame 10 comprises a pair of vertical door jambs or members 14 and 16 which have their upper ends connected by a horizontal member 18, all of which along with the floor 20 define a door opening 22 which receives the door 12. One vertical edge of the door 12 is hingedly connected to the door jamb 14 by means of hinges 24. Located near the other vertical edge of the door is a conventional door knob 26. The structure is conventional and is well known.

Figure 2:
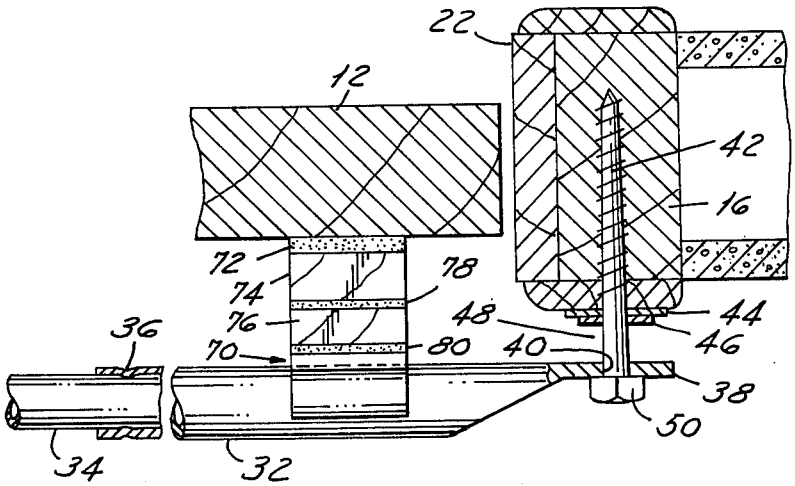
FIG. 2 is a sectional view taken on the line 2—2 of FIG. 1.

The mechanical security device or door guard 30 is designed to fit any swinging door less than, as an example, 42 inches in width. The door guard 30 includes an elongated latching member or bar 31 comprising a pair of tubular elements 32 and 34, with the tubular element 34 being telescopically received within the interior of the tubular member 32 as best illustrated in FIG. 2. When installing the mechanical security device 30, it is first necessary to determine the length of the bar 31 by telescoping the bar parts or tubular elements 32 and 34 across the door 12 until the ends thereof overlap each door jamb comfortably. In order to determine where the mechanical clips or hardware are located on the door jambs, it is first necessary to determine that the latching member 31 when swung vertically does not hit the floor 20. The latching member 31 is also adjusted to make sure that the end portions overlap the jamb members 14 and 16. Thereafter, once the proper length of the latching member 31 has been determined, a hammer and punch is used to form an indentation 36 (FIG. 2) in tubular member 32 to thereby connect the members 34 and 32 together thus locking the two parts of the latching member 31 in place and forming in effect a single unit or latching member 31. An end cap 33 made from plastic material is fitted over the free end of the tubular part 34 thereby closing the interior thereof.

The tubular part 32 has one end closed and flattened to provide a relatively flat formation 38 (FIG. 2) having a centrally located bolt opening provided therein. The latching member 31 is hingedly connected to the door jamb 16 by means of a threaded lag screw 42 which extends through the formation 38 into the jamb 16 as best illustrated in FIG. 2. A decorative label 44 is adhesively secured to the door jamb 16 and has on the front side thereof a washer 46. The lag screw 42 extends through the washer 46 and an opening in the label 44 as best illustrated in FIG. 2. The lag screw 42 is not screwed all the way into the door jamb 16 but sufficient space 48 is provided between the screw head 50 and formation 38 and the door jamb 16 to allow the latching member 31 to swing up and down freely. Also the formation 38 and the end of the member 32 can be moved on the screw 42 towards the jamb 16 when required thus reducing the space between formation 38 and jamb 16. It will be appreciated that the elongated lag screw 42 forms a pivot connection for the latching connection for the latching member 31.

The latching member 31 has an operative position and an inoperative position. As shown in FIG. 1, the latching member 31 is in an operative position extending laterally across the door 12 to maintain the door 12 in a closed position in the door opening 22. When the latching member 31 is in an inoperative position, it is arranged to one side of the door opening 22 paralleling the door jamb 16, with the free end portion thereof held in the plastic storage clip 52 mounted below the pivot screw 38 on the jamb 16.

Figure 3:
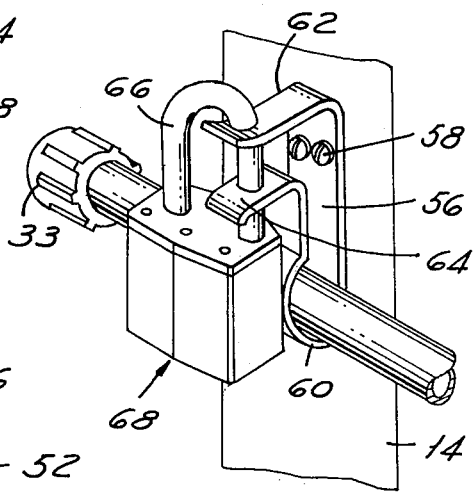
FIG. 3 is a fragmentary view of the mechanical security device and one door jamb and illustrating the latching member locked in place by a padlock.

A generally J-shaped cradle clamp or clip 54 is secured on the door jamb 14 opposite the pivot screw 38. The cradle clamp 54 is of a one piece steel construction and includes a generally flat base portion 56 provided with two openings through which a pair of screws 58 extend into the door jamb 14. The cradle clip 54 further includes a generally U-shaped cradle portion 60 designed to fit and engage the tubular member 34 as illustrated in FIG. 1. The terminal ends of the base portion 56 and cradle portion 60 are provided respectively with horizontally arranged parallel flanges 62 and 64 which are provided with openings which are aligned and which are adapted to receive the U-shaped bolt element 66 on a padlock 68 as best illustrated in FIG. 3.

As an optional feature in order to provide further stability for the latching member 31, spacing means or a spacing unit is rotatably secured to the latching member 31 on a horizontal line between the pivot screw 38 and the cradle clip 54 to fill the space between the latching member 31 and the door. The spacing means of unit includes a resilient plastic clip 70 which is of identical construction to storage clip 52 except that it is longer and includes a pair of resilient fingers which grip the tubular part 32 of latching member 31 near but spaced from the pivot screw 42 as shown in FIG. 1. The spacing means also includes a cushion pad 72 made from cork, which is adapted to engage the door 12 (as shown in FIG. 2), a pair of spaced wood blocks 74 and 76 which are adhesively connected by an adhesive pad 78, and another adhesive pad 80 which secures the wood blocks to the spacer clip 70. The pad 72 is adhesively secured to block 74 and provides a cushion which engages the door.

Figure 4:
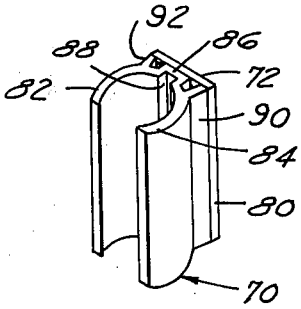
FIG. 4 is a perspective view of a storage or spacer clip.

FIG. 4 shows the spacer clip 70 (or storage clip 52) which is made from a plastic material and comprising a pair of yieldable or flexible arms or fingers 82, 84 engageable with the opposing cylindrical portions of the tubular part 32 to provide support for the latching member 31. The spacer clip 70 and connected parts are used to make the latching bar 31 fit tightly against the door 12. In certain applications the wood blocks 74 and 76 may not be required to take up the space. The cork pad 72 is used to prevent door abrasion.

The spacer clip 70 (or storage clip 52) includes a base 86 provided with a slot 88. Spaced from the longitudinal edges of the base 86 are legs 90 and 92. An adhesive cushion 80 is secured to the bottom surfaces provided on the base 86 and the legs 90 and 92. The base 86 and legs 90 and 92 are constructed and arranged to permit the fingers 82 and 84 to yield or flex as required.

The mechanical security device 30 provides increased security at nominal cost. When not in use the latching bar 31, pivoted at one end, hangs unobtrusively besides the door jamb 15 ready for use. To secure, simply raise the latching bar 31 and drop it in the cradle clip 54. In some applications it is desirable to use the padlock 68 to seal the door to outsiders. To release, after removing the padlock 68, simply lift the latching bar 31 and swing same to its inoperative position.

As a result of the pivoting of the latching bar 31, increased leverage results. A person can open the door slightly to see who is there and then open or secure the door as required. With the resulting leverage, a 100 pound woman can easily secure the door against a 200 pound man.

If the spacing means or unit including the spacer clip 70 and blocks 74 and 76 are used, it may be necessary to rotate clip 70 and the parts attached thereto on the latching member 31 through approximately 90° degrees in order to allow or permit the latching member 31 to be stored in storage clip 52 in its inoperative position. Such rotation moves the spacer clip to a position where it will not strike frame member 16 and thus possibly interfere with the storage of the latching member 31 in a flat condition against frame member 16.

I claim:

1. A combination of a door frame defining a door opening, a door vertically swingable relative to said frame at one side thereof for opening and closing said door opening, and an elongated mechanical security device including an elongated latching member having operative and inoperative positions, said mechanical security device being carried by the frame, with said latching member when in an operative position maintaining the door in a closed position in said door opening, said frame comprising a pair of vertical members, said door being hingedly connected at one edge thereof to one of said vertical member, said elongated latching member having on one end thereof a formation provided with an opening, fastening means extending through the opening in said formation into said other of the vertical members and mounting said latching member for pivotal movement between said operative and inoperative positions, said elongated mechanical security device including a one piece elongated cradle clip secured to said one vertical member for receiving the other end of said elongated latching member, said cradle clip being of generally J-shaped configuration and having a generally flat base portion abutting and secured to said one vertical member and a generally U-shaped cradle portion for receiving said latching member, said base and cradle portions terminating in generally horizontal and parallel flanges which are spaced apart and which are provided with aligned openings for receiving a padlock for locking the latching member when in its operative position, said latching member comprising a pair of telescopically arranged elongated tubular elements being closed and flattened on one end thereof to provide said formation, said mechanical security device including a storage clip secured on said other vertical member and spaced substantially below said fastening means, said storage clip being of part-circular configuration and including a pair of resilient finger which receive said other end of said latching member when in an inoperative position, said storage clip being made from plastic and is adhesively secured to said other vertical member.

2. The combination defined in claim 1 wherein said tubular elements after adjustment to fit the door frame are secured together by a fastening element extending transversely through the elements.

3. The combination defined in claim 1 wherein spacing means is secured to said latching member on a line between said fastening means and said cradle clip, said spacing means occupying the space between said latching member and the door when said latching member is in its operative position.

4. A combination of a door frame defining a door opening, a door vertically swingable relative to said frame at one side thereof for opening and closing said door opening, and an elongated mechanical security device including an elongated latching member having operative and inoperative positions, said mechanical security device being carried by the frame, with said latching member when in an operative position maintaining the door in a closed position in said door opening, said frame comprising a pair of vertical members, said door being hingedly connected at one edge thereof to one of said vertical members, said elongated latching member having on one end thereof a formation provided with an opening, fastening means extending through the opening in said formation into said other of the vertical members and mounting said latching member for pivotal movement between said operative and inoperative positions, said elongated mechanical security device including a one piece elongated cradle clip secured to said one vertical member for receiving the other end of said elongated latching member, said cradle clip being of generally J-shaped configuration and having a generally flat base portion abutting and secured to said one vertical member and a generally U-shaped cradle portion for receiving said latching member, said base and cradle portions terminating in generally horizontal and parallel flanges which are spaced apart and which are provided with aligned openings for receiving a padlock for locking the latching member when in its operative position, said latching member comprising a pair of telescopically arranged elongated tubular elements being closed and flattened on one end thereof to provide said formation, spacing means secured to said latching member on a line between said fastening means and said cradle clip, said spacing means occupying the space between said latching member and the door when said latching member is in its operative position, said spacing means including a spacer clip which is of part-circular configuration and includes a pair of resilient fingers which grip the latching member.

5. The combination defined in claim 4 wherein said spacing means is rotatable on said latching member, said spacer clip being made from a plastic material.

* * * * *